United States Patent [19]

Deutschländer

[11] Patent Number: 4,723,701

[45] Date of Patent: Feb. 9, 1988

[54] METHOD OF MAKING A WRAPPER SLEEVE PACKAGE AND PACKAGE MADE BY THE METHOD

[75] Inventor: Gert Deutschländer, Neuhausen am Rheinfall, Switzerland

[73] Assignee: SIG Schweizerische Industrie-Gesellschaft, Neuhausen am Rheinfall, Switzerland

[21] Appl. No.: 942,984

[22] Filed: Dec. 17, 1986

[30] Foreign Application Priority Data

Dec. 24, 1985 [CA] Canada ..... 5543/85

[51] Int. Cl.[4] ..... B65D 65/12; B65D 65/14; B65D 75/08; B65D 75/12

[52] U.S. Cl. ..... 229/87 F; 53/450; 53/550

[58] Field of Search ..... 229/87 F, 87 R; 53/450, 53/550

[56] References Cited

U.S. PATENT DOCUMENTS

| | | | |
|---|---|---|---|
| 1,556,056 | 10/1925 | Weeks | 229/87 R |
| 1,640,052 | 8/1927 | Olsen, Jr. | 229/87 F |
| 2,527,692 | 10/1950 | Andrews | 229/87 F |
| 3,112,860 | 12/1963 | Ehrlund | 229/87 R |
| 3,210,200 | 10/1965 | Billeb | 229/87 F |
| 4,272,944 | 6/1981 | Suga | 53/550 |

FOREIGN PATENT DOCUMENTS

| | | | |
|---|---|---|---|
| 851272 | 1/1940 | France | 229/87 F |
| 505195 | 11/1952 | Italy | 229/87 F |
| 254978 | 1/1949 | Switzerland . | |
| 679052 | 9/1952 | United Kingdom . | |

*Primary Examiner*—Stephen P. Garbe

*Attorney, Agent, or Firm*—Spencer & Frank

[57] ABSTRACT

A wrapped article and a method of packaging it in a wrapper of sealable material includes the steps of surrounding the article about its side faces with the wrapper, providing the wrapper with a longitudinal seam to obtain a wrapper sleeve projecting beyond the end faces; flattening the wrapper sleeve beyond the end faces and providing transverse seams in the wrapper sleeve beyond the end faces to obtain fins projecting therebeyond, folding each fin along a root edge thereof against the respective end face to extend parallel thereto; folding side margins of each fin through 180° along respective side edges onto the fin; and folding an outer edge zone of each fin through 180° along a respective top edge onto a respective end face.

12 Claims, 8 Drawing Figures

METHOD OF MAKING A WRAPPER SLEEVE PACKAGE AND PACKAGE MADE BY THE METHOD

BACKGROUND OF THE INVENTION

This invention relates to a method of forming a package from a wrapper sleeve which is of a heat-sealable material and which is provided with a longitudinal seam as well as fin seals at opposite longitudinal ends.

According to conventional package making methods, wrapper sleeve packages, particularly for chocolate bars are formed by wrapping the mutually spacedly delivered bars with a continuous wrapper and providing the wrapper with a longitudinal seam to thus obtain a wrapper sleeve. After laying flat the longitudinal seam onto the underside of the package, the wrapper sleeve is pressed flat between two adjoining bars, sealed and then severed, whereby at both ends of each package a fin seal is provided. Such packages can be manufactured inexpensively and with high output. The required machinery thus needs only simple sealing shoes and low sealing temperatures because the sealing seam is of the single-layer type.

It is a disadvantage of the package made as outlined above that the width of the fin seals is substantial, thus lending the package an inferior appearance. For this reason, such a package is rarely used, if at all, for wrapping high-quality products. Further, such large-dimension fins require substantial space which is an added disadvantage in boxed packaging, display racks or vending machines.

For the above reasons, aesthetically more pleasing packages are made with pinch folds provided at the longitudinal package ends as described, for example, in U.K. Pat. No. 679,052. According to such a method, at the ends of the package, at two opposite narrow sides, a pinch fold is formed prior to pressing the sleeve flat. Subsequent to such pressing and sealing, the transverse seam at the two ends of the package does not exceed the width of the wrapped product. Consequently, it may be folded down onto the end faces of the package and glued thereto. Due to the structure of the pinch fold, the end seam is partly single-layered, partly dual-layered. For this reason difficulties are encountered in obtaining satisfactory sealing properties. Higher sealing temperatures have to be used to ensure that a proper seal is provided at the dual-layered zone as well. This, however, involves the problem that the sealing temperature will be too high for the single-layered zone and therefore longer cooling periods have to be provided. Consequently, these packages cannot be produced with an output as high as that for the fin-seal packages outlined earlier.

A further wrapper sleeve package with pinch fold is disclosed in Swiss Pat. No. 254,978. In this case too, the seam at the ends of the package is single-layered in part and double-layered in part so that the same problems are encountered as concerns seal quality and output as in the arrangement according to the earlier-described U.K. Pat. No. 679,052. In addition, in the package the flap of the lateral end closure is folded onto that large surface which is free from the longitudinal seam. Consequently, the two large faces of the bar can only be used with difficulty, if at all, as display surfaces so that such packages conventionally have to be provided with a second wrapper, representing additional expense.

SUMMARY OF THE INVENTION

It is an object of the invention to provide an improved method of making a package of the above-outlined type which ensures a satisfactory seal at the end closures of the package, which makes possible a high output and which results in packages of pleasing appearance.

These objects and others to become apparent as the specification progresses, are accomplished by the invention, according to which, briefly stated, in a first folding operation the fins are folded about their inner (root) edge such that each fin assumes a position parallel to the adjoining end face of the package, and in a second folding operation the side margins of each fin are folded over along the side edges of the package about 180° and in a third folding operation that outer edge zone of each fin which projects beyond the boundary edge of the package is, with the previously inwardly folded side margins, folded over 180° to the end face of the package and is secured thereto.

DESCRIPTION OF THE PREFERRED EMBODIMENTS

Figures 1, 2, 3, 4, 5, 6, 7, 8:
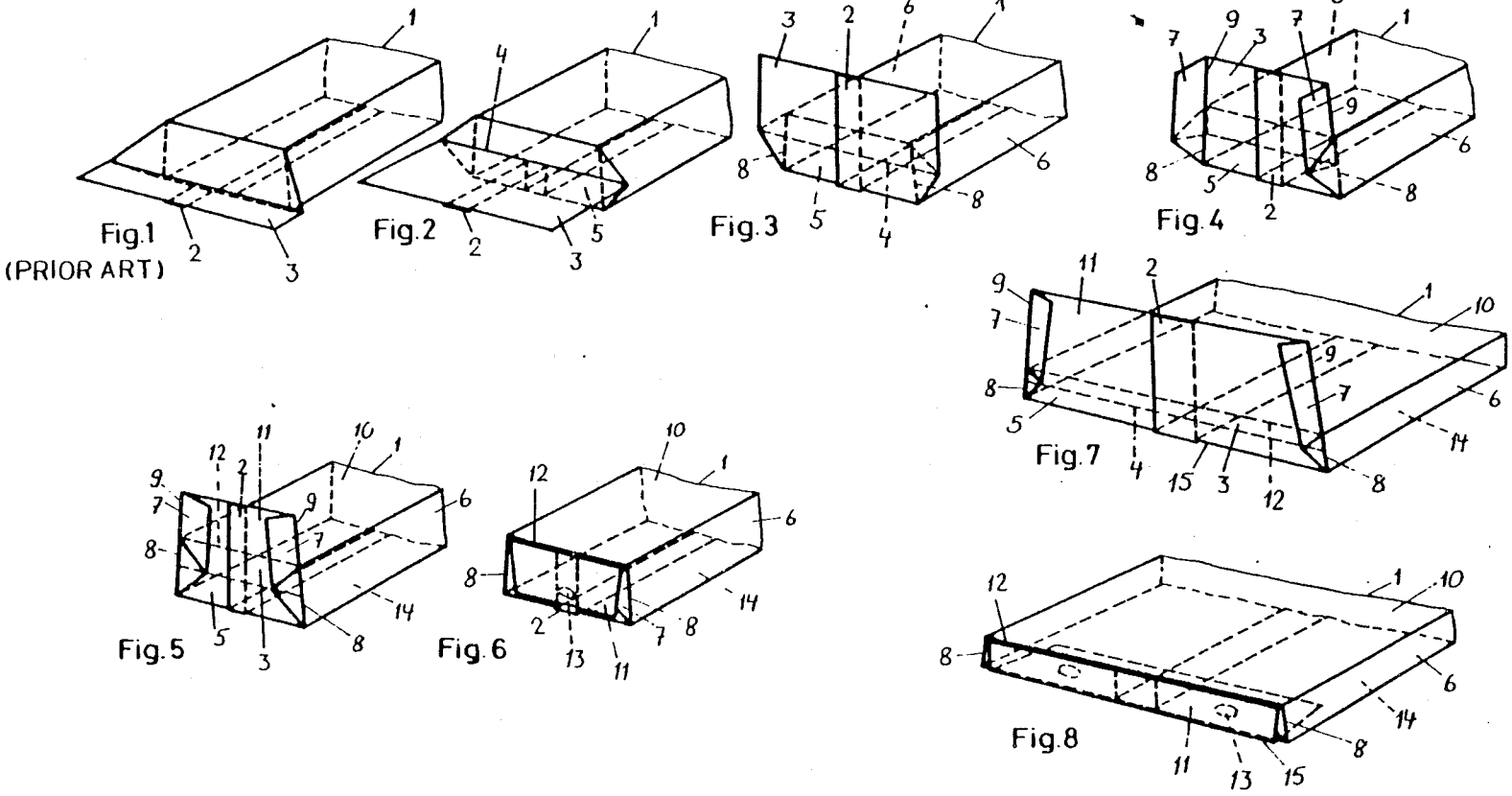
Fig.1 (PRIOR ART)
FIG. 1 is a perspective view of a package depicted in an operational phase of a method according to the prior art.
FIGS. 2–6 are perspective views of a package showing sequential packaging phases of a method according to a preferred embodiment of the invention.
FIGS. 7 and 8 are schematic perspective views of a package depicting two phases of a method according to another preferred embodiment of the invention.

Turning to FIG. 1, for forming the packages according to the invention, the articles to be packaged (in particular chocolate bars) are advanced spaced from one another in the direction of feed and are wrapped by a continuous, heat-sealable wrapper 1. The longitudinal edges of the wrapper are bonded to one another by means of a longitudinal seam 2 which is subsequently folded flat onto the underside of the package. The wrapper sleeve formed in this manner is subsequently pressed together between consecutive bars and sealed by forming a fin 3 and thereafter the individual packages are separated from one another. These operational steps are conventional and result in a package with known end closures as shown in FIG. 1.

Turning to FIG. 2, as a departure from the above-outlined making of the end closure of the package, according to the invention the fin 3 is pressed together until the wrapper lies tightly against the end face 5 of the bar and the fin is thereafter sealed so that the inner transverse edge (root) 4 of the fin 3 lies against the end face 5 of the bar as illustrated in FIG. 2.

The fin 3 is thereafter folded through 180° about the root 4 so that it assumes a position in which it extends parallel to the end face 5, as shown in FIG. 3. In this operation the folding direction is such that the longitudinal seam 2 on the fin 3 is oriented away from the article.

The lateral marginal edge portions (side margins) 7 which form part of the fin 3 and which project beyond the side faces 6 of the article are folded in two steps about a crease line 9 along side edges 8 through 180° onto the fin 3 in a direction away from the article 1, as shown in FIGS. 4 and 5.

As the last step shown in FIG. 6, the outer edge zone 11 of the fin 3, projecting beyond the top face 10 of the package is folded downwardly about the upper transverse top edge 12 of the package through 180° and is secured by a hot adhesive spot 13 on the end face 5. It will be understood that instead of an adhesive spot the bonding of the edge zone 11 may be effected by heat-sealing as well.

In case of relatively thin items, such as relatively thin chocolate bars, the downfolded outer edge zone 11 of the fin 3 may, as a result of the last folding operation, project beyond the underside 14 of the package. According to a modified embodiment of the invention as illustrated in FIGS. 7 and 8, the part of the outer edge zone 11 which projects beyond the underside 14 is folded through 90° along the bottom transverse edge 15 and secured by a hot adhesive spot 13 to the underside 14 of the package.

The above-described method as well as the package obtained with the method have at least the following significant advantages over the prior art:

- the transverse sealing seams at the longitudinal ends of the package extend throughout as one layered constructions and therefore highly satisfactory sealing properties with high manufacturing speeds may be obtained;
- at the edge faces the end closure has an uninterrupted outer face which may be used for promotional messages and which is aesthetically very satisfactory;
- the downwardly folded edge zone 11 of the fin 3 substantially conceals any irregularities in the folding and therefore the appearance of the package is not adversely affected by inaccuracies in the manufacture;
- in boxed packages, display stands or vending machines significant space is saved as compared to packages having conventional fins. Also, the packages may be stacked much better, lending the stack a pleasing appearance;
- in boxed packages, display stands and vending machines, the folded fins 3 have the function of shock absorbers and reinforcing means resulting in a good protection of the products from mechanical interferences.

The present disclosure relates to subject matter contained in Swiss patent application No. 5543/85 (filed Dec. 24th, 1985) which is incorporated herein by reference.

It will be understood that the above description of the present invention is susceptible to various modifications, changes and adaptations, and the same are intended to be comprehended within the meaning and range of equivalents of the appended claims.

What is claimed is:

1. In a method of packaging an article in a wrapper of sealable material, the article having a top face, a bottom face, opposite side faces, opposite end faces, side edges formed by an intersection of side faces with end faces; top edges formed by an intersection of end faces with the top face; and bottom edges formed by an intersection of the end faces with the bottom face; including the steps of surrounding the article about said side faces with said wrapper, providing the wrapper with a longitudinal seam to obtain a wrapper sleeve projecting beyond said end faces; flattening the wrapper sleeve beyond said end faces and providing transverse seams in said wrapper sleeve beyond said end faces to obtain fins projecting beyond each said end face; each fin having side margins projecting beyond a width of the article defined by a distance between said opposite side faces; the improvement comprising the following consecutive steps:

(a) folding each said fin along a root edge thereof against the respective end face to extend parallel thereto; each said fin having an outer edge zone projecting beyond said top face;

(b) folding the side margins of each fin through 180° along respective side edges onto a respective said fin; and (c) folding said outer edge zone of each fin through 180° along a respective said top edge onto a respective said end face.

2. A method as defined in claim 1, wherein step (a) includes the step of folding the fins in a direction such that said longitudinal seam on each fin is oriented away from the article when the fins assume a parallel orientation to said end faces.

3. A method as defined in claim 2, wherein step (b) includes the step of folding the side margins in a direction such that the side margins assume a position on a face of the fin containing said longitudinal seam.

4. A method as defined in claim 1, further comprising the steps of folding, subsequent to step (c), a marginal zone portion of said fins projecting beyond said bottom face, along respective said bottom edges onto said bottom face and securing said marginal zone portion to said bottom face.

5. A method as defined in claim 4, wherein the securing step includes the step of securing with a hot-melt adhesive.

6. A method as defined in claim 1, further comprising the step of securing, subsequent to step (c), said outer edge zone of each said fin to said respective end face.

7. A method as defined in claim 5, wherein the securing step includes the step of securing with a hot-melt adhesive.

8. A package including a wrapper sleeve enclosing an article having a top face, a bottom face, opposite side faces, opposite end faces, side edges formed by an intersection of side faces with end faces; top edges formed by an intersection of end faces with the top face; and bottom edges formed by an intersection of the end faces with the bottom face, the package being obtained by the method comprising the following steps:

(a) surrounding the article with said wrapper about said side faces;

(b) providing the wrapper with a longitudinal seam to obtain a wrapper sleeve projecting beyond said end faces;

(c) flattening the wrapper sleeve beyond said end faces and providing transverse seams in said wrapper sleeve beyond said end faces to obtain fins projecting beyond each said end face; each fin having a root edge extending along a respective said end face and side margins projecting beyond a width of the article defined by a distance between said opposite side faces;

(d) folding each said fin along the root edge against the respective end face to extend parallel thereto; each said fin having an outer edge zone projecting beyond a respective said top edge;

(e) folding the side margins of each fin through 180° along respective side edges onto a respective said fin; and (f) folding said outer edge zone of each fin through 180° along a respective said top edge onto a respective said end face.

9. A package as defined in claim 8, further comprising securing means for attaching said outer edge zone of each said fin to said respective end face.

10. A package as defined in claim 9, wherein said securing means comprises a hot-melt adhesive.

11. A package as defined in claim 8, wherein the method further comprises the step of folding, subsequent to step (c) a marginal zone portion of said fins projecting beyond said bottom face, along respective said bottom edges onto said bottom face and securing said marginal zone portion to said bottom face.

12. A package as defined in claim 11, wherein said marginal zone portion is secured to said bottom face by a hot-melt adhesive.

* * * * *

UNITED STATES PATENT AND TRADEMARK OFFICE

CERTIFICATE OF CORRECTION

PATENT NO. : 4,723,701

DATED : February 9th, 1988

INVENTOR(S) : Gert Deutschländer

It is certified that error appears in the above-identified patent and that said Letters Patent is hereby corrected as shown below:

In the heading of the patent, under [30], the country of the priority application should read --Switzerland--.

Signed and Sealed this

Twelfth Day of July, 1988

*Attest:*

DONALD J. QUIGG

*Attesting Officer*

*Commissioner of Patents and Trademarks*